US005110105A

United States Patent [19]

Nicoll et al.

[11] Patent Number: 5,110,105

[45] Date of Patent: May 5, 1992

[54] SHEET HANDLING APPARATUS

[75] Inventors: Kenneth A. Nicoll; Adam J. L. Johnston, both of Dundee, Scotland

[73] Assignee: NCR Corporation, Dayton, Ohio

[21] Appl. No.: 659,770

[22] Filed: Feb. 25, 1991

[30] Foreign Application Priority Data

Aug. 17, 1990 [GB] United Kingdom ..... 9018078

[51] Int. Cl.[5] ..... B65H 5/22

[52] U.S. Cl. ..... 271/5; 384/218; 384/439; 271/263; 271/274; 271/20; 271/90; 271/119; 271/11

[58] Field of Search ..... 271/262, 263, 264, 272, 271/273, 274, 20, 90, 119, 5, 11; 384/218, 439, 252, 256

[56] References Cited

U.S. PATENT DOCUMENTS

| | | | |
|---|---|---|---|
| 1,777,807 | 10/1930 | Pecker | 384/218 |
| 2,738,239 | 3/1956 | Campbell | 384/256 |
| 3,077,983 | 2/1963 | Middleditch | 271/263 X |
| 3,265,383 | 8/1966 | Shute | 271/20 X |
| 3,731,916 | 5/1973 | Pettet | 271/263 |
| 3,902,716 | 9/1975 | Lewis | 271/263 |
| 4,340,150 | 7/1982 | Guibord et al. | 221/21 |

FOREIGN PATENT DOCUMENTS 1529815 10/1978 United Kingdom .

*Primary Examiner*—H. Grant Skaggs
*Assistant Examiner*—Carol Lynn Druzbick
*Attorney, Agent, or Firm*—Albert L. Sessler, Jr.

[57] ABSTRACT

A cash dispenser unit includes note transport means (74, 78, 86) driven by an electric motor and including first (74) and second (78) sets of rolls which are arranged to grip therebetween a note (18'), partly withdrawn from a currency cassette (14) by associated pick arms (36), for the purpose of removing the note (18') from the cassette (14). The first (74) and second (78) sets of rolls are respectively mounted on first (76) and second (80) shafts, the first shaft (76) being mounted so that one end thereof is movable away from the second shaft (80). For the purpose of protecting the transport means (74, 78, 86) from damage in the event of the occurrence of a gulp feed of notes, said one end of the first shaft (76) is operatively associated with a microswitch, whereby movement of said one end away from the second shaft (80) by more than a predetermined amount operates the microswitch so as to deenergize the motor.

3 Claims, 5 Drawing Sheets

SHEET HANDLING APPARATUS

BACKGROUND OF THE INVENTION

This invention relates to a sheet handling apparatus for removing sheets one by one from a stack of sheets held in a container and for feeding said sheets towards an output station.

The invention has application, for example, to a cash dispenser unit of an automated teller machine (ATM) in which there is provided currency note picking apparatus for extracting notes from one or more currency cassettes mounted in the cash dispenser unit. As is well known, in operation of an ATM a user inserts a customer identifying card into the machine and then enters certain data (such as codes, quantity of currency required or to be paid in, type of transaction, etc.) upon one or more keyboards associated with the machine. The machine will then process the transaction, update the user's account to reflect the current transaction, dispense cash, when requested, extracted from one or more currency cassettes, and return the card to the user as part of a routine operation.

One known kind of cash dispenser unit of an ATM includes a currency note picking mechanism which incorporates pivotably mounted pick arms disposed adjacent an associated currency cassette, the pick arms being arranged to draw part of an end note of a stack of notes in the cassette away from the remainder of the stack, by applying suction force to the end note, and to position said part for engagement by transport means arranged to remove the end note from the cassette. In a typical cash dispensing operation, the transport means feed a plurality of notes one by one to note stacking means where the notes are stacked in a bundle, the bundle of notes then being fed to an output station, represented by a cash exit slot, for collection by a user of the ATM.

It can sometimes happen that, in operation of a currency note picking mechanism, due to a malfunction of the mechanism, a so-called gulp feed occurs in which a plurality of currency notes, instead of a single note, are erroneously picked from the cassette in one cycle of operation of the pick mechanism. Such a malfunction may occur, for example, if the cassette has been loaded incorrectly, or if a note pusher mechanism in the cassette has become jammed. When a gulp feed occurs, the gear wheels driving the note transport means may be highly stressed and one or more gear wheels may fail. Even though only one gear wheel may fail as a result of a gulp feed, all other gears in the driving system will have been so highly stressed that it is likely that further use will soon result in more failures. Thus, once a gulp feed has occurred, it is likely that a major gear change will be required before the pick mechanism can be used again with any confidence.

SUMMARY OF THE INVENTION

According to the invention there is provided a sheet separating apparatus for removing sheets one by one from a stack of sheets held in a container and for feeding said sheets towards an output station, comprising sheet engaging means arranged to withdraw part of an end sheet of said stack away from the remainder of said stack to position said part for further transport; transport means including first and second shafts, first and second roll means mounted on said shafts and arranged to grip therebetween the end sheet from said stack of sheets positioned by said sheet engaging means for the purpose of removing said sheet from said container, an electric motor for driving said roll means, and switch means operatively associated with one end of said first shaft, and deenergizing said motor when operated, said first shaft being mounted so that said one end is movable spatially relative to said second shaft, whereby movement of said one end away from said second shaft by more than a predetermined amount brings about operation of said switch means; and a supporting framework having a wall with a rectangular aperture therein, and a movable bearing slidably mounted for vertical movement in said aperture and having an end portion corresponding to said one end of said first shaft mounted therein; said apparatus also including a fixed bearing secured to the supporting framework and receiving a portion of said first shaft spaced from said end portion of said first shaft, said first shaft being pivotable about said fixed bearing.

It is accordingly an object of the present invention to provide a sheet handling apparatus for removing sheets one by one from a stack and for feeding said sheets to an output station, which apparatus incorporates means for protecting the apparatus from damage in the event of a gulp feed occurring.

With this and other objects, which will become apparent from the following description, in view, the invention includes certain novel features of construction and combinations of parts, a preferred form or embodiment of which is hereafter described with reference to the drawings which accompany and form a part of this specification.

DETAILED DESCRIPTION

Figure 1:
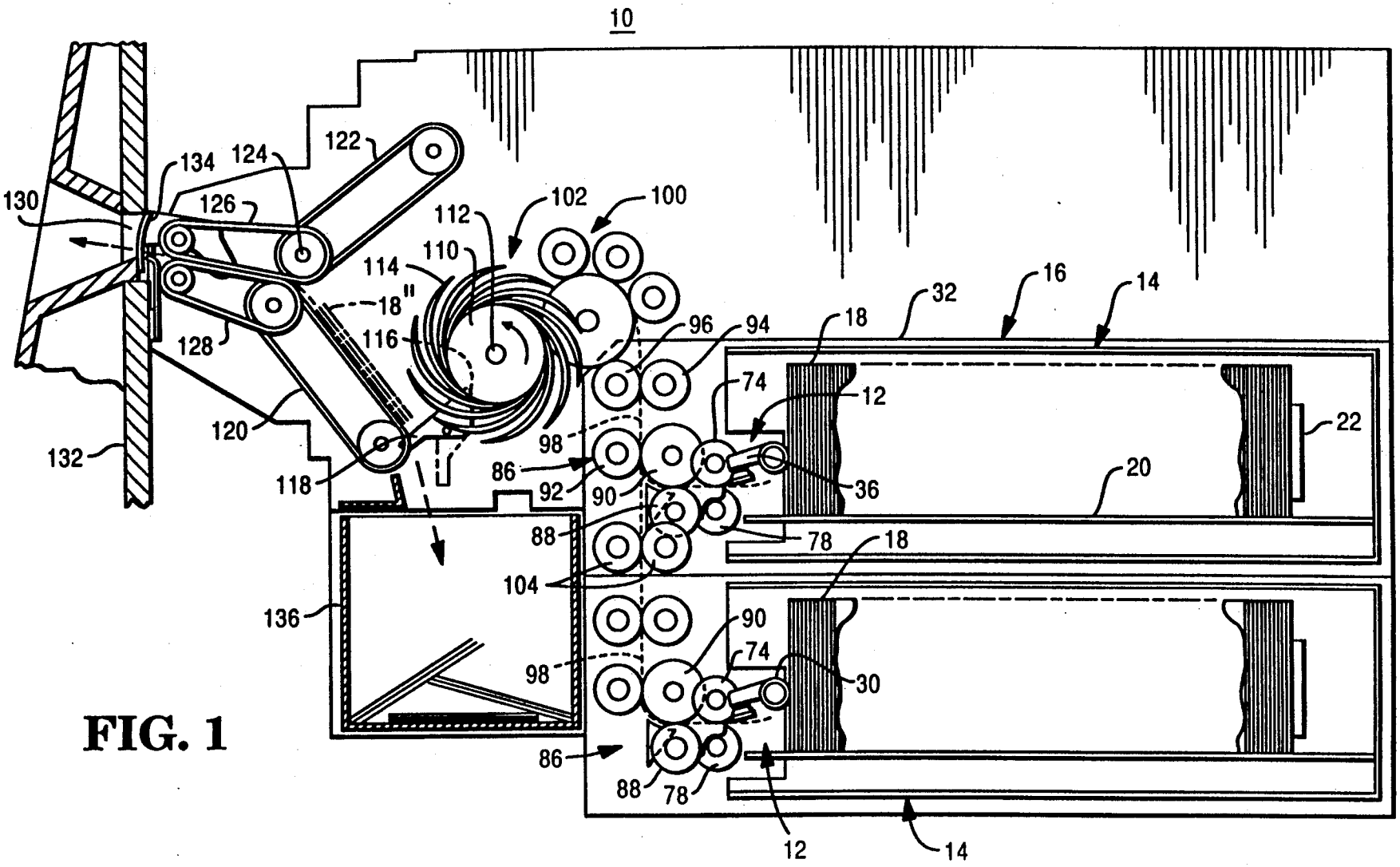
FIG. 1 is a schematic side elevational view of a cash dispenser unit of an ATM incorporating a currency note handling apparatus in accordance with the invention, with parts of said apparatus being omitted.

Referring to FIG. 1, the cash dispenser unit 10 shown therein includes two similar pick mechanisms 12 arranged one above the other and respectively associated with two currency cassettes 14 which are removably mounted in a supporting framework 16 of the dispenser 10. Each of the cassettes 14 is arranged to contain a stack of currency notes 18, corresponding long edges of which are supported on a horizontal support plate 20 mounted in the cassette 14. The two cassettes 14 respectively contain notes 18 of different denominations.

Figure 2:
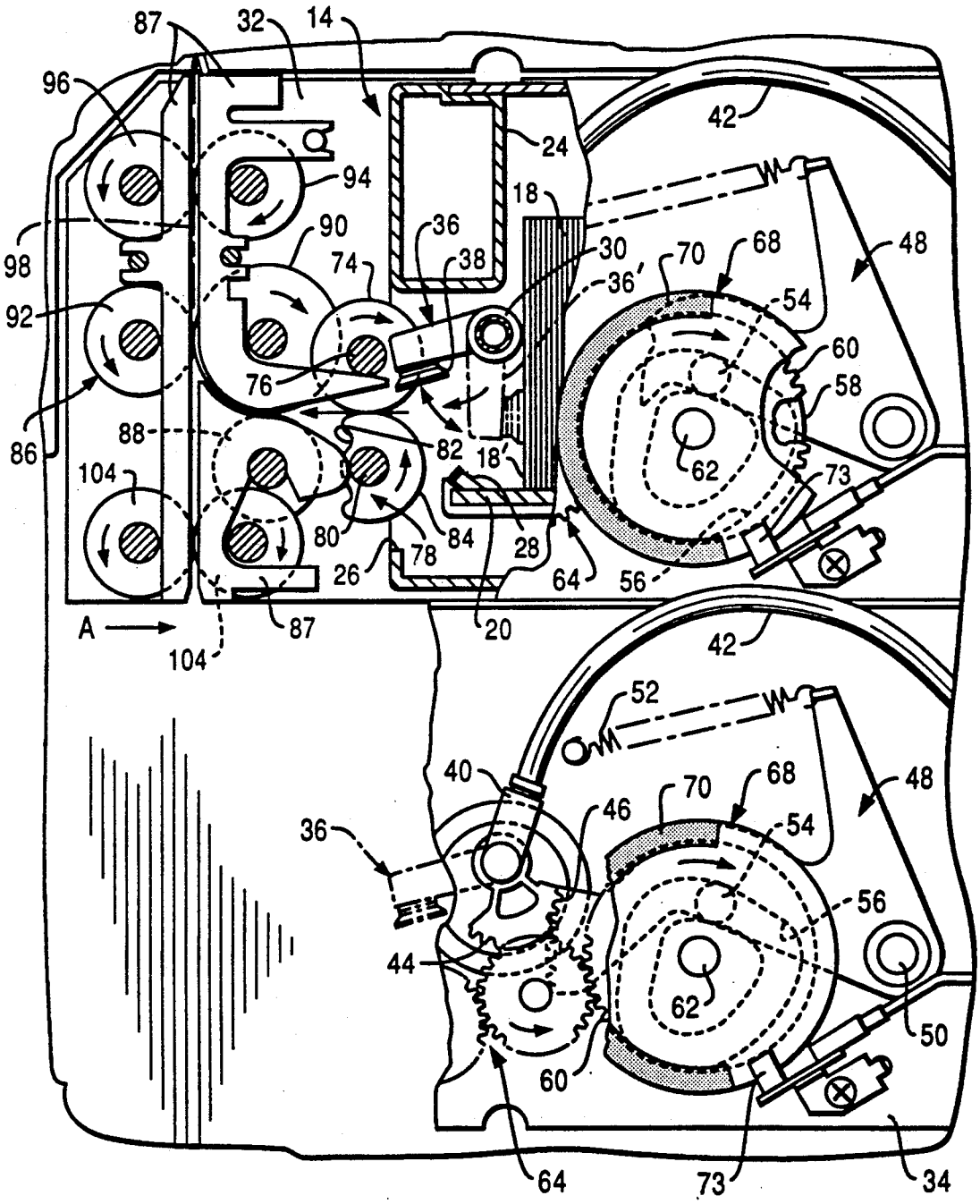
FIG. 2 is an enlarged part sectional side elevational view of part of the cash dispenser unit of FIG. 1, shown partly broken away and showing additional details of the note handling apparatus.

Referring now additionally to FIG. 2, the stack of notes 18 in each cassette 14 is urged by a spring loaded pusher member 22 (FIG. 1) towards a stop member 24 (FIG. 2) mounted at the front end (left hand end with reference to FIGS. 1 and 2) of the cassette 14. An opening 26 (FIG. 2) is formed in the front end of each cassette 14, the opening 26 being normally closed by conventional shutter means (not shown) when the cassette 14 is not mounted in the dispenser unit 10. When a cassette 14 is mounted in its correct operational position in the dispenser unit 10, the relevant shutter means is automatically retracted away from its closed position so as to enable currency notes 18 to be extracted through the opening 26 by the associated pick mechanism 12. Brushes 28 are provided at the front end of the support plate 20 of each cassette 14 for a purpose which will be explained later.

Each pick mechanism 12 includes a tubular member 30 which extends between, and is rotatably mounted with respect to, side walls 32 and 34 of the framework 16. Two conventional pick arms 36, each incorporating a rubber suction pad 38, are secured on each tubular member 30, each pick arm 36 communicating with the interior of the associated tubular member 30. Corresponding ends of the tubular members 30 project beyond the side wall 34, and are each connected by a respective swivel elbow connector 40 to a respective rubber tube 42 via which reduced pressure is applied in operation to the respective tubular member 30.

Figure 6:
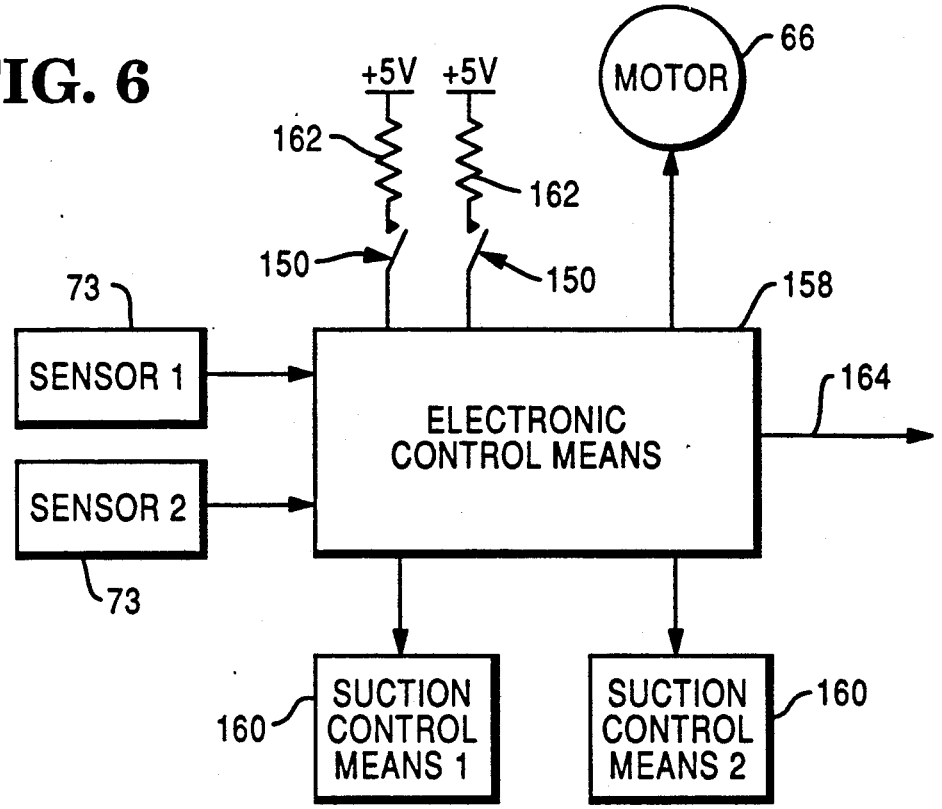
FIG. 6 is a schematic block diagram illustrating electrical interconnections between parts of the cash dispenser unit.

A gear segment 44 is secured to that part of each tubular member 30 projecting beyond the side wall 34, the gear segment 44 being in cooperative engagement with a toothed end portion 46 of a first arm of a respective bell crank lever 48 which is pivotally mounted on a stud 50 secured to the outer surface of the wall 34. Each lever 48 is urged to rotate in a counterclockwise direction with reference to FIG. 2 by means of a spring 52 the ends of which are respectively attached to the side wall 34 and to the end of the second arm of the lever 48. A stud 54 is secured to one side of each lever 48, the stud 54 engaging in a cam track 56 formed in an associated cam member 58. Each cam member 58 is secured to a respective gear wheel 60 which is rotatably mounted on a respective shaft 62 projecting from the outer surface of the side wall 34. The gear wheels 60 are driven by a gear mechanism 64 operated by a main drive electric motor 66 (FIG. 6). In operation, with the , motor 66 energized, the gear wheels 60 are rotated in a clockwise direction with reference to FIG. 2. This rotation of the gear wheels 60 brings about an oscillatory pivotal movement of the levers 48 by virtue of the engagement of the studs 54 in engagement with the inner edges of the cam tracks 56. By virtue of the engagement of the gear segments 44 with the toothed portions 46 of the levers 48, the oscillatory movement of the levers 48 brings about an oscillatory pivotal movement of the assemblies of the tubular members 30 and the associated pick arms 36. As will be explained in more detail later, the oscillatory movement of either of the assemblies of the tubular members 30 and associated pick arms 36 is effective to cause currency notes to be picked one by one from the stack of currency notes 18 held in the associated currency cassette 14.

A timing disc 68 is secured to that face of each gear wheel 60 remote from the associated cam member 58. Each timing disc 68 is for the most part transparent but incorporates an arcuate opaque strip 70 extending around just over half the periphery of the disc 68. Each timing disc 68 is associated with optical sensing means, comprising an LED (not shown) and a cooperating phototransistor sensor 73, which is arranged to sense the opaque strip 70. In operation, as each assembly of a gear wheel 60 and the associated cam member 58 and timing disc 68 rotates in response to energization of the motor 66, the associated sensor 73 generates output signals in response to the sensing of the leading and trailing edges of the associated opaque strip 70. It should be understood that the signals generated by each of the sensors 73 provide indications as to the precise positions of the associated pick arms 36 at the times when these signals are generated.

Figure 3:
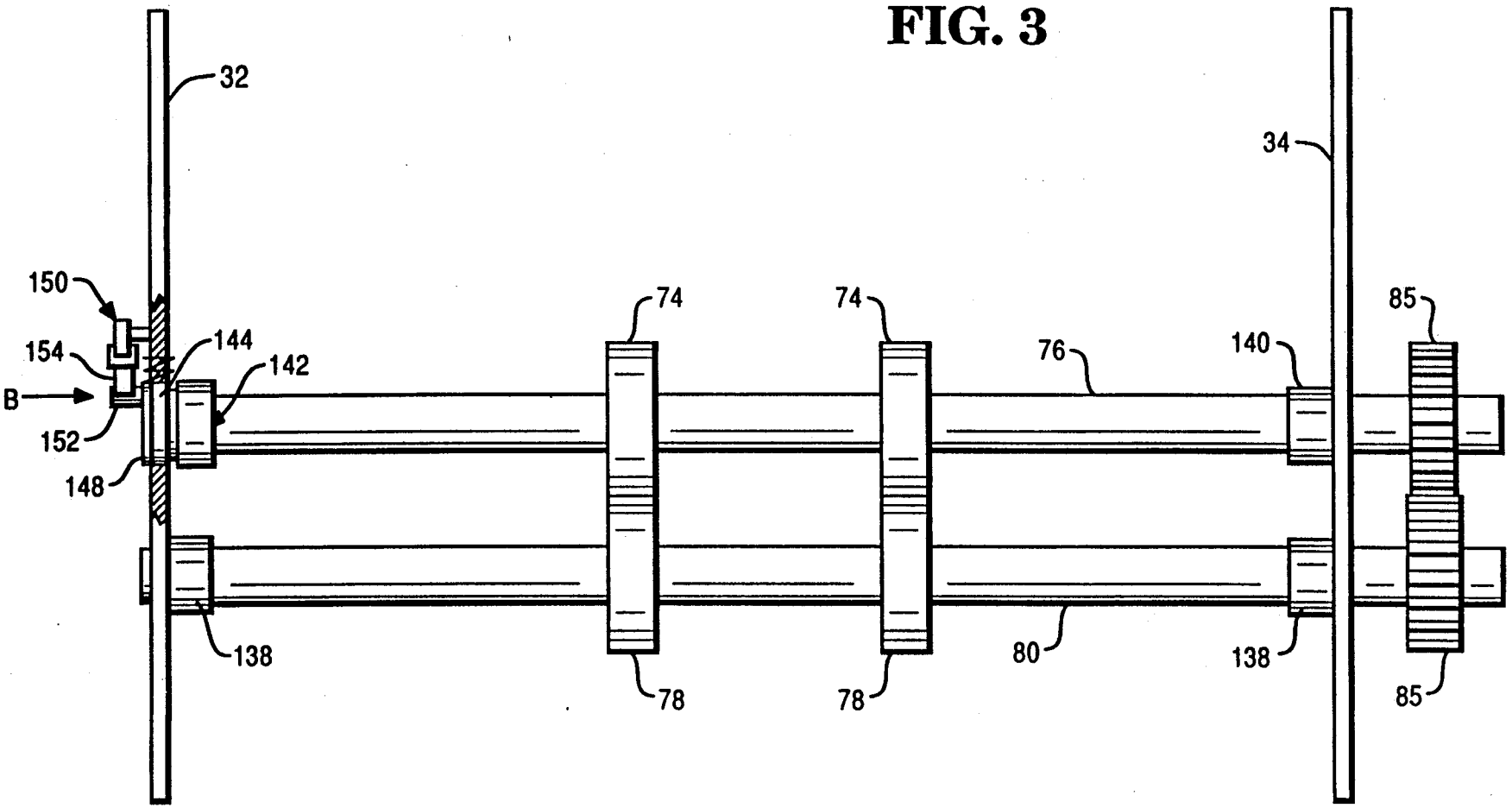
FIG. 3 is an elevational view of part of a pick mechanism of the apparatus shown in FIG. 2, the view being taken in the direction of the arrow A in FIG. 2.

Referring now also to FIG. 3, each pick mechanism 12 also includes a first set of rolls 74 secured on a drive shaft 76, and a second set of rolls 78 (hereinafter referred to as cam rolls) which are secured on a drive shaft 80 in cooperative relationship with respect to the rolls 74, and whose peripheries comprise low portions 82 and high portions 84. The drive shafts 76 and 80 extend between, and are rotatably mounted with respect to, the side walls 32 and 34, and are respectively driven by two gear wheels 85 forming part of the gear mechanism 64 so that in operation the rolls 74 and the cam rolls 78 respectively rotate in clockwise and counterclockwise directions with reference to FIG. 2, the rolls 74 and the cam rolls 78 making two revolutions for each revolution of the timing discs 68. In the course of a normal pick operation, the lower long edge of the first currency note 18' of the stack of notes 18 in the relevant cassette 14 is pulled partly out of the cassette 14, under the action of suction force applied by the respective pick arms 36, and is fed between the low portions 82 of the respective cam rolls 78 and the associated rolls 74 as the arms 36 are pivoted in a clockwise direction from the position 36' shown in chain outline in FIG. 2 to the position shown in solid outline. The note 18' is thereafter pulled completely out of the cassette 14 by virtue of being gripped between the rolls 74 and the high portions 84 of the cam rolls 78.

The cash dispenser unit 10 includes two note transport mechanisms 86 respectively associated with the two pick mechanisms 12, the transport mechanisms 86 being driven by the gear mechanism 64 previously referred to. Each transport mechanism 86 includes guide means 87 and sets of feed rolls 88, 90, 92, 94, and 96 for feeding a currency note picked by the associated pick mechanism 12 along a respective feed path 98 towards a further transport mechanism 100 which is positioned above the mechanism 86 and which is also driven by the gear mechanism 64. The transport mechanism 100 serves to feed currency notes one by one to a conventional stacking wheel 102. The sets of cam rolls 78 and cooperating rolls 74 of each pick mechanism 12 feed a picked currency note to cooperating sets of rolls 88 and 90, from where the note is fed by cooperating sets of rolls 90 and 92 and cooperating sets of rolls 94 and 96 upwardly out of the respective transport mechanism 86. The upper one of the transport mechanisms 86 additionally includes two further sets of cooperating rolls 104 for accepting a currency note fed upwardly out of the lower transport mechanism 86 and for feeding this note to the cooperating rolls 90 and 92 of the upper mechanism 86, from where the note is fed to the transport mechanism 100.

Referring now particularly to FIG. 1, the stacking wheel 102 is driven by the motor 66 and is arranged to rotate continuously in operation in a counterclockwise direction. Means (not shown) are provided between the upper transport mechanism 86 and the stacking wheel 102 for detecting any multiple feeding of notes and for detecting any invalid or torn note. The stacking wheel 102 comprises a plurality of stacking plates 110 spaced apart in parallel relationship along the stacker wheel shaft 112, each stacking plate 110 incorporating a series of curved tines 114. The tines 114 of the stacking plates 110 pass between portions 116 of a rockably mounted stripper plate assembly 118. In operation, each note fed by the transport mechanism 100 to the stacking wheel 102 enters between adjacent tines 114 and is carried partly around the axis of the stacking wheel 102, the note being stripped from the wheel 102 by the portions 116 and being stacked against belt means 120 with a long edge of the note resting on the stripper plate assembly 118. The belt means 120 cooperates with belt means 122 normally held in the position shown in FIG. 1. When a bundle of notes 18" (or possibly a single note only) to be dispensed to a user in response to a cash withdrawal request has been stacked against the belt means 120, the belt means 122 is rocked in a clockwise direction about a shaft 124 so as to trap the bundle of notes 18" between the belt means 120 and the belt means 122. It should be understood that in the course of this rocking movement separate belts making up the belt means 122 pass between adjacent pairs of the stacking plates 110.

Assuming that none of the notes in the bundle 18" have been rejected for any reason, the belt means 120 and 122 are operated so as to drive the bundle 18" to a pair of drive belt means 126 and 128. The belt means 126 and 128 serve to drive the bundle 18" through a note exit slot 130 in a housing 132 of the ATM to a position where the bundle 18" can be collected by the user of the ATM, a shutter 134 which serves to close the slot 130 when the ATM is not in operation having previously been retracted to an open position. It should be understood that the belt means 120 and 122 are mounted in resilient relationship relative to each other, and the belt means 126 and 128 are also mounted in resilient relationship relative to each other, so that bundles of notes of varying thickness can be held between, and fed by, the belt means 120 and 122 and the belt means 126 and 128. If a multiple feeding has been detected in the course of stacking the bundle of notes 18" against the belt means 120, or if one or more of the notes in the bundle 18" have been rejected for any other reason, then the stripper plate assembly 118 is rocked into the position shown in chain outline in FIG. 1, and the belt means 120 and 122 are operated to feed the bundle 18" in a direction opposite to the normal feed direction, the bundle 18" being deposited in a reject note container 136 via an opening in the top thereof.

Figure 4A:
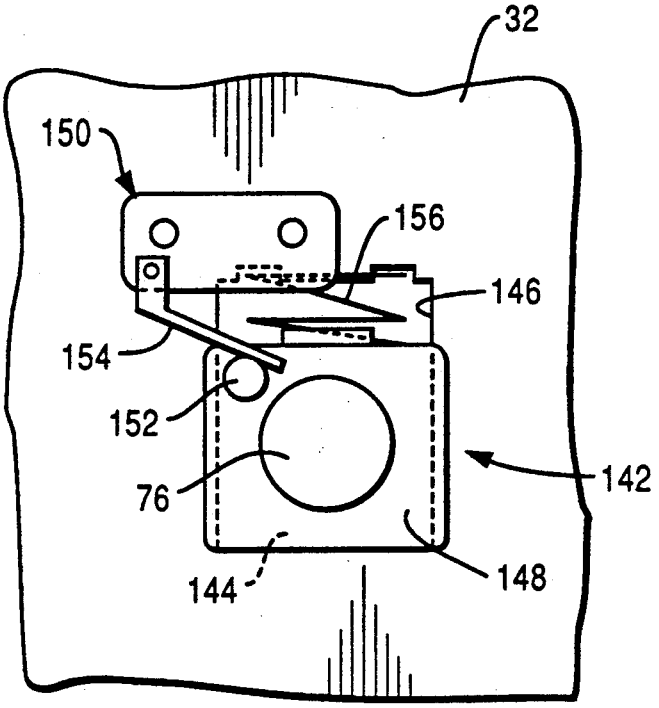
FIGS. 4A and 4B are enlarged, side elevational views of part of the mechanism shown in FIG. 3, these views being taken in the direction of the arrow B in FIG. 3 and showing different operational positions of parts of the mechanism.
Figure 4B:
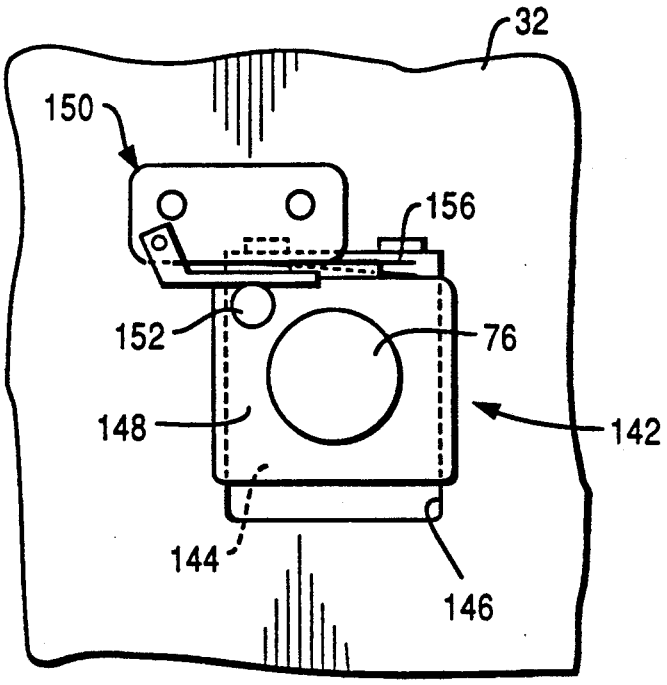

Referring now particularly to FIG. 3 and FIGS. 4A and 4B, the shaft 80 of each pick mechanism 12 is mounted in fixed bearings 138 respectively secured to the side walls 32 and 34, while the shaft 76 is mounted in a fixed bearing 140 secured to the wall 34 and in a movable bearing 142 adjacent the side wall 32. It should be understood that the fixed bearing 140 and the intermeshing gear wheels 85 permit a certain amount of pivotal movement of the shaft 76 in a clockwise direction (with reference to FIG. 3) about the center of the bearing 140. The bearing 142 includes a portion 144 which extends through, and is a sliding fit in, a generally rectangular aperture 146 formed in the side wall 32. The portion 144 is provided with flanges 148 which are in sliding contact with the outer surface of the wall 32. That end of the shaft 76 adjacent the wall 32 is operatively associated via the bearing 142 with a microswitch 150 mounted on the outer surface of the wall 32, a stud 152 formed on the portion 144 being in engagement with an operating lever 154 of the microswitch 150. Normally, the portion 144 of the bearing 142 is biased downwardly into contact with the lower edge of the aperture 146 by means of a compression spring 156 positioned between the top of the portion 144 and the upper edge of the aperture 146. The normal positions of the shaft 76, the portion 144 and the microswitch 150 are as shown in FIGS. 3 and 4A, the microswitch 150 being in an open condition when in its normal position. As will be explained in more detail later, in the event of the gulp feed occurring, the bearing 142 is urged upwardly away from the shaft 80, against in FIG. 4B, the portion 144 sliding upwardly along the aperture 146 in the wall 32 and the shaft 76 pivoting about the center of the bearing 140. During this upward movement of the bearing 142, the operating lever 154 of the microswitch 150 is pivoted in a counterclockwise direction (with reference to FIGS. 4A and 4B) by the stud 152 so as to close the microswitch 150.

Figure 5A:
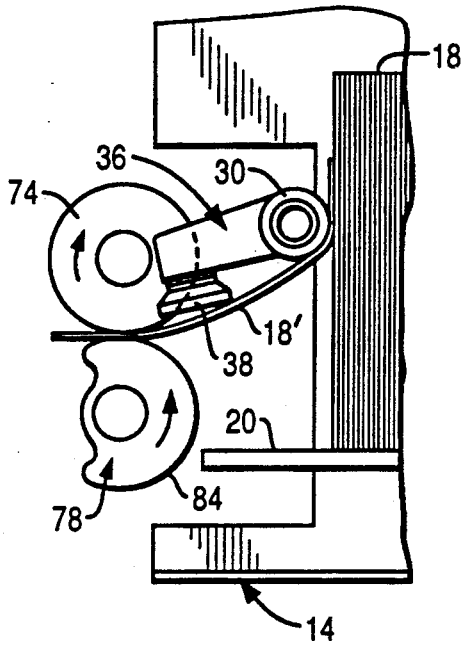
FIGS. 5A and 5B are schematic views respectively illustrating a normal pick operation and a pick operation involving a gulp feed.

The operation of the cash dispenser unit 10 will now be described with additional reference to FIGS. 5A and 5B and FIG. 6. This operation is controlled by electronic control means 158 (FIG. 6) of the cash dispenser unit 10. The electronic control means 158 is connected to the motor 66, to each phototransistor sensor 73, and to a suction control means 160 of each pick mechanism 12. Also the microswitch 150 of each pick mechanism 12 is connected in series with a resistor 162 between the electronic control means 158 and a positive voltage supply. When the main ATM processor (not shown) sends a request to the electronic control means 158 that one or more currency notes are to be dispensed by the dispenser unit 10 in response to a cash withdrawal request by a user of the ATM, the control means 158 sends a signal to the motor 66 so as to switch on the motor 66 and cause the assemblies of the gear wheels 60, cams 58 and timing discs 68 to commence to rotate. Shortly thereafter, the electronic control means 158 initiates the sending of signals to the suction control means 160 of a selected one of the pick mechanisms 12 so as to connect the tubular member 30 of the selected pick mechanism 12 in controlled manner to a source (not shown) of reduced pressure, thereby initiating the picking of notes from the associated cassette 14. The timing of the application of reduced pressure to the tubular member 30, and hence to the associated suction pads 38, is under the control of signals generated by the phototransistor 73 of the selected pick mechanism 12.

As previously explained, in response to rotational movement of the gear wheel 60 of the selected pick mechanism 12, the pick arms 36 of this pick mechanism 12 will undergo an oscillatory , movement. In known manner, while the picking of notes from the associated cassette 14 is taking place, for each pivotal movement of the pick arms 36 in a clockwise direction (with reference to FIG. 2), the pick arms 36 apply a suction force to the first note 18' of the stack of notes 18 held in the cassette 14 so as to pull the lower part of the note 18' out of the cassette 14 until the lower end of the note 18' comes into contact with the set of rolls 74.

It should be understood that, as the lower end of the note 18' is approaching the rolls 74, the lower portions 82 of the cam rolls 78 are facing the rolls 74 so that the cam rolls 78 do not interfere with the movement of the note 18'. The suction pads 38 become disengaged from the note 18' when the high portions 84 of the cam rolls 78 are about to come into cooperative relationship with the rolls 74, and the note 18' is then gripped between the rolls 74 and the high portions 84 of the cam rolls 78 as shown in FIG. 5A. The rolls 74 and 78 pull the note 18' away from the cassette 14 until the leading edge of the note 18' enters the nip of the rolls 88 and 90 of the associated transport mechanism 86, after which the note 18' is pulled completely out of the cassette 14 and fed to the stacking wheel 102 in the manner previously described.

After the note 18' has been fed to the stacking wheel 102, the electronic control means 158 may cause a series of further pick operations to be carried out in each of which a currency note is picked from one or another of the cassettes 14. Upon the control means 158 ascertaining that the correct number and denomination of currency notes have been picked from the cassettes 14, the control means 158 returns the cash dispenser unit 10 to its quiescent condition by de-energizing the motor 66.

When the first note 18' is being picked from the associated cassette 14, it is possible, due to a certain amount of porosity of the first note 18', for the second note of the stack of notes 18 to commence to be drawn away from the remainder of the stack together with the first note 18'. The brushes 28 will normally prevent the second note being drawn out of the cassette 14 together with the first note 18', since, in the event of the first and second notes commencing to be drawn out of the cassette 14, the brushes 28 flex the lower ends of these notes, thereby interrupting the application of suction force to the second note and so permitting the second note to fall back into its correct position in the cassette 14.

Figure 5B:
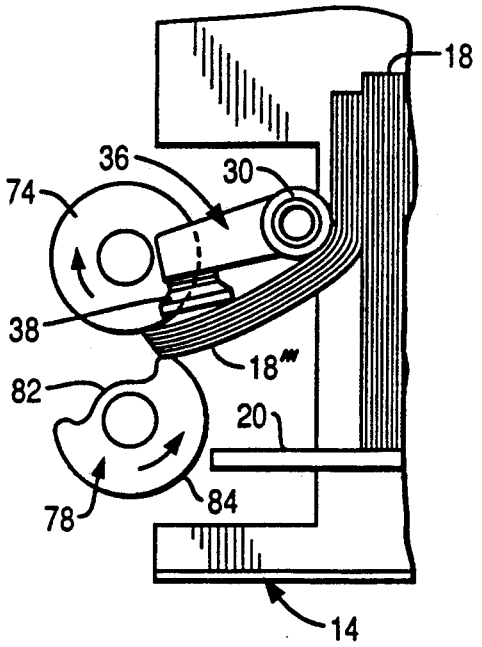

In the event of a gulp feed occurring, for example due to incorrect loading, or jamming of the pusher member 22, of the relevant cassette 14, a bunch of notes 18''' may be drawn out of the cassette 14 and become gripped between the rolls 74 and the leading edges of the high portions 84 of the cam rolls 78 as shown in FIG. 5B. Following the gripping of the bunch of notes 18''' between the high portions 84 and the rolls 74, continued rotation of the rolls 78 causes the rolls 74 to be pushed upwardly away from the cam rolls 78 thereby causing the movable bearing 142 to be moved upwardly along the aperture 146 in the wall 32 away from the shaft 80. Upward movement of the movable bearing 142 continues until that end of the shaft 76 adjacent the wall 32 becomes spaced from the shaft 80 by more than a predetermined amount, whereupon the microswitch 150 is closed and a high signal is applied to the electronic control means 158 via the closed microswitch 150. In response to receipt of this high signal, the electronic control means 158 immediately deenergizes the motor 66 so as to stop operation of the gear mechanism 64 which drives the pick mechanisms 12 and the transport mechanisms 86 and 100. At the same time, the electronic control means 158 sends a signal over an output line 164 to the main ATM processor (not shown), this signal indicating that a gulp feed has occurred in the cash dispenser unit 10. It should be understood that, when a gulp feed occurs, the motor 66 is deenergized before the gear mechanism 64 and associated parts are subjected to any significant stress. Upon the note jam being cleared by an operator, the ATM in which the cash dispenser unit 10 is incorporated is ready to recommence operation without any other reservicing being necessary.

Thus, the mechanism described above incorporating the movable bearing 142 and the associated microswitch 150 provides a simple and effective means of protecting the cash dispenser unit 10 from damage in the event of a gulp feed occurring.

In the particular embodiment described above, the microswitch 150 is closed when there occurs a gulp feed involving a bunch of notes having an overall thickness of more than 2 millimeters (about 20 notes in number). Picking of multiple notes having an overall thickness of not more than 2 millimeters by one of the pick mechanisms 12 will not cause a jam or any damage to the gear mechanism 64, such multiple notes being detected by the multiple note detect means previously referred to and being diverted to the reject note container 136.

While the form of the invention shown and described herein is admirably adapted to fulfill the object primarily stated, it is to be understood that it is not intended to confine the invention to the form or embodiment disclosed herein, for it is susceptible of embodiment in various other forms within the scope of the appended claims.

What is claimed is:

1. Sheet handling apparatus for removing sheet one by one from a stack of sheets held in a container and for feeding said sheets toward an output station, comprising:

sheet engaging means arranged to withdraw part of an end sheet from said stack away from the remainder of said stack to position said part for further comprising;

transport means including first and second shafts, first and second roll means mounted on said first and second shafts and arranged to grip therebetween the end sheet from said stack of sheets positioned by said sheet engaging means for the purpose of removing said sheet from said container, an electric motor for driving said roll means, and switch means operatively associated with one end of said first shaft and deenergizing said motor when operated, said first shaft being mounted so that said one end is movable spatially relative to said second shaft, whereby movement of said one end away from said second shaft by more than a predetermined amount brings about operation of said switch means; and a supporting framework having a wall with a rectangular aperture therein, and a movable bearing slidably mounted for vertical movement in said aperture and having an end portion corresponding to said one end of said first shaft mounted therein;

the sheet handling apparatus also including a fixed bearing secured to the supporting framework and receiving a portion of said first shaft spaced from said end portion of said first shaft, said first shaft being pivotable about said fixed bearing.

2. The sheet handling apparatus of claim 1, also including spring means for urging said movable bearing to a home position relative to said framework, said home position corresponding to a normal operating position of said first shaft.

3. The sheet handling apparatus of claim 1, in which said switch means includes an operating member and said movable bearing includes an actuating member adapted to engage with said operating member for the purpose of operating said switch means when said first shaft moves pivotally around said fixed bearing so that said one end of said first shaft is spaced from said second shaft by more than said predetermined amount.

* * * * *

UNITED STATES PATENT AND TRADEMARK OFFICE

CERTIFICATE OF CORRECTION

PATENT NO. : 5,110,105

DATED : May 5, 1992

INVENTOR(S) : Nicoll et al.

It is certified that error appears in the above-identified patent and that said Letters Patent is hereby corrected as shown below:

Column 8, line 26, "sheet" should be --sheets--.

Column 8, line 32, after "further" insert --transport, --.

Column 8, line 33, delete "comprising;".

Signed and Sealed this

Twenty-sixth Day of October, 1993

*Attest:*

*Attesting Officer*

Bruce Lehman

BRUCE LEHMAN

*Commissioner of Patents and Trademarks*